US006616127B1

(12) United States Patent
Smith

(10) Patent No.: US 6,616,127 B1
(45) Date of Patent: Sep. 9, 2003

(54) VEHICLE RAMP STABILIZING ASSEMBLY

(76) Inventor: George R. Smith, P.O. Box 73, Pinellas Park, FL (US) 33780

( * ) Notice: Subject to any disclaimer, the term of this patent is extended or adjusted under 35 U.S.C. 154(b) by 0 days.

(21) Appl. No.: 10/103,935

(22) Filed: Mar. 22, 2002

(51) Int. Cl.[7] ..... B66F 19/00
(52) U.S. Cl. ..... 254/88
(58) Field of Search ..... 254/88; 14/69.5, 14/71.1; 248/188.2, 346.01, 352

(56) References Cited

U.S. PATENT DOCUMENTS 1,871,129 A * 8/1932 Pierce ..... 254/88
4,993,685 A 2/1991 Sparling
5,118,081 A 6/1992 Edelman
5,176,361 A 1/1993 Ayala
D351,710 S 10/1994 Richardson
5,446,937 A 9/1995 Haskins
5,608,951 A * 3/1997 Chou ..... 24/302
5,863,026 A 1/1999 Gano et al.

* cited by examiner

*Primary Examiner*—Robert C. Watson

(57) ABSTRACT

A vehicle ramp stabilizing assembly for holding a vehicle ramp in a stationary position relative to a vehicle driving onto the ramp includes an attachment assembly, a belt portion, and a length adjustment assembly. The attachment assembly attaches to the ramp around a front wheel of the vehicle to permit adjustment and positioning of the ramp even after a rear wheel of the vehicle engages the belt portion.

6 Claims, 3 Drawing Sheets

VEHICLE RAMP STABILIZING ASSEMBLY

BACKGROUND OF THE INVENTION

1. Field of the Invention

The present invention relates to stabilized vehicle ramps and more particularly pertains to a new vehicle ramp stabilizing assembly for holding a vehicle ramp in a stationary position relative to a vehicle driving onto the ramp.

2. Description of the Prior Art

The use of stabilized vehicle ramps is known in the prior art. U.S. Pat. No. 5,863,026 describes a base ramp combined with a ramp extension that attaches to the base ramp to provide a more gradual slope than the base ramp alone. Another type of stabilized vehicle ramp is U.S. Pat. No. 5,118,081 having a flexible web that is extendable outwardly from beneath a leading edge of a ramp to be engaged by the front wheels of a vehicle to hold the ramp in a stable position when the vehicle is driven onto the ramp. U.S. Pat. No. 4,993,685 discloses a vehicle ramp having a first end of a web either fixedly coupled to the ramp or fixedly coupled to an axle rotatably coupled to the ramp, and a second end of the web extending out from beneath a leading edge of the ramp to be engaged by the front wheels of a vehicle to hold the ramp in a stable position when the vehicle is driven onto the ramp. U.S. Pat. No. 5,446,937 discloses interlocking ramp portions for providing a unitary ramp with a gradual slope. U.S. Pat. No. 5,176,361 is exemplary of attempts to solve the problem of ramp slippage in a different manner by enhancing the frictional engagement between the sloped face of a ramp and a wheel of a vehicle driving onto the ramp. U.S. Pat. No. Des. 351,710 shows an ornamental appearance for a single wheel vehicle ramp.

While these devices fulfill their respective, particular objectives and requirements, the need remains for a device that is adjustable in length and engages the rear wheel of a vehicle as opposed to the front wheel, thus permitting manual adjustment of the ramp itself even after the rear wheel has engaged a belt portion of the device.

SUMMARY OF THE INVENTION

The invention is typically utilized in association with a pair of ramps, each ramp being of the type that supports a single wheel of a vehicle. The purpose of such single wheel supporting ramps is to provide a ramping method that is easily used and manipulated by a single person. However, the single wheel supporting ramps sacrifice some stability for lightness to permit easier handling. As a result of the reduced weight and stability, the ramps are subject to being pushed by a vehicle wheel until the wheel and ramp engage each other to permit the wheel to move up onto the ramp. An added problem is that separate wheels may not engage the respective ramps simultaneously resulting in improper support of the vehicle by the ramps. Thus, there is a need for stabilization of the single wheel ramps to enhance safety and facilitate simultaneous movement of wheels onto separate ramps.

The present invention meets the needs presented above by providing a belt portion extendably coupled to a ramp attachment assembly by a length adjustment assembly. The ramp attachment assembly is positioned to extend around the front wheel of a vehicle to permit adjustment and positioning of the ramp even after the rear wheel of the vehicle engages the belt portion. The structure described above is duplicated for use on each side of the vehicle as needed.

Still yet another object of the present invention is to provide a new vehicle ramp stabilizing assembly that has an adjustable length for use with vehicles having differing wheelbase dimensions.

Even still another object of the present invention is to provide a new vehicle ramp stabilizing assembly that has a mechanism for locking a length adjustment assembly into a selectable fixed length during use.

To this end, the present invention generally comprises an attachment assembly, a belt portion, and a length adjustment assembly having a locking mechanism for holding the device at a selected length during use.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
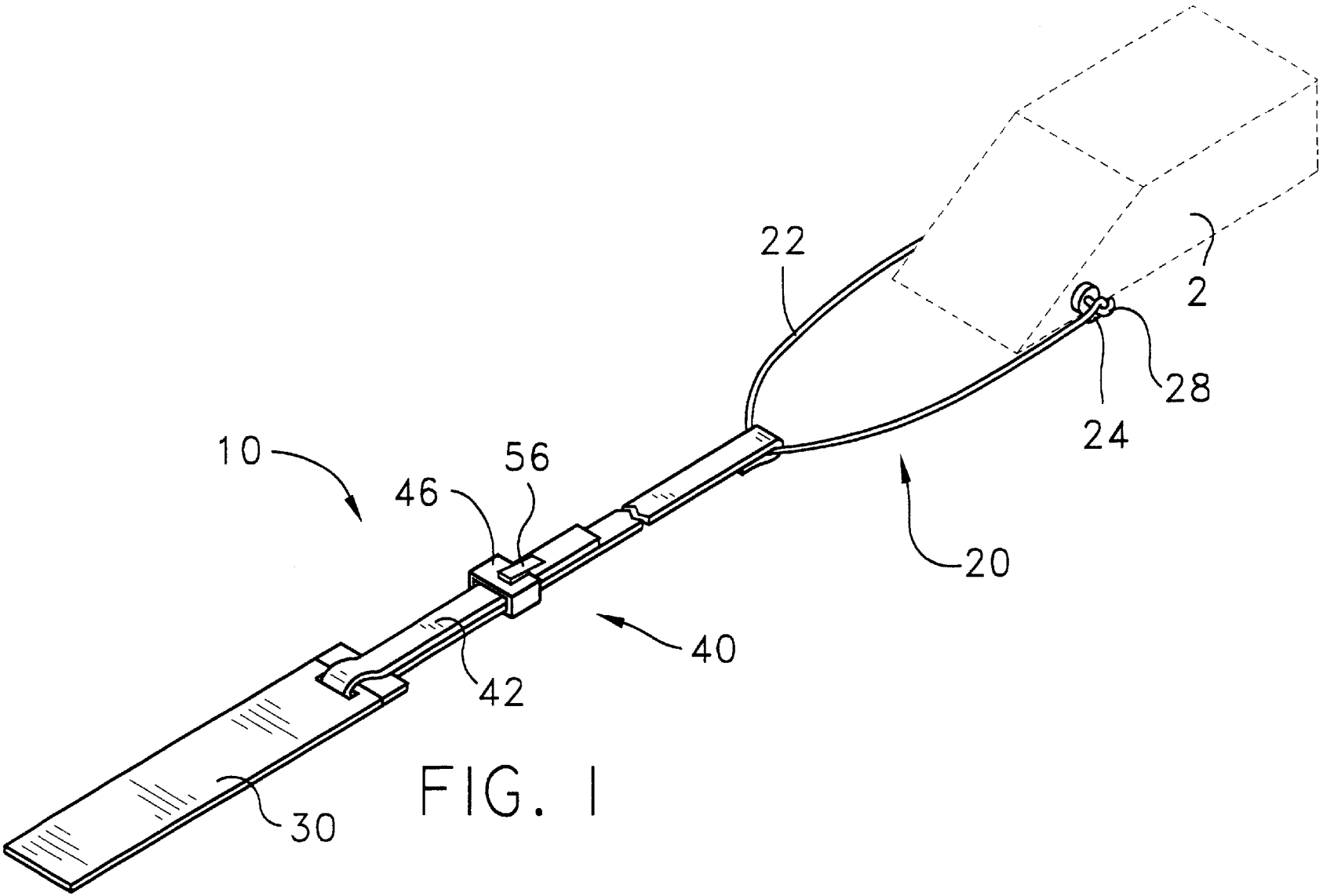
FIG. 1 is a perspective view of a new vehicle ramp stabilizing assembly according to the present invention.
Figure 2:
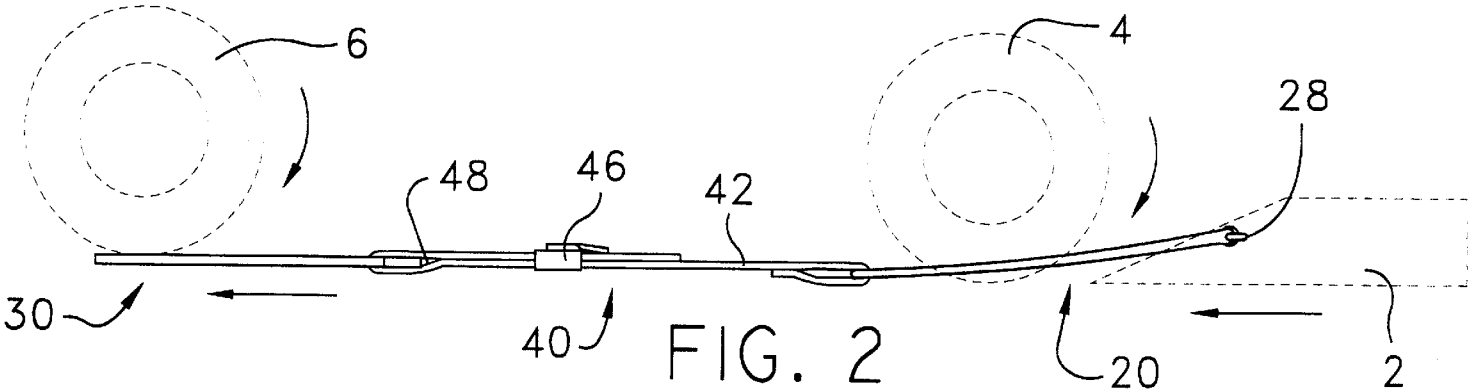
FIG. 2 is a side view of the present invention in use.
Figure 3:
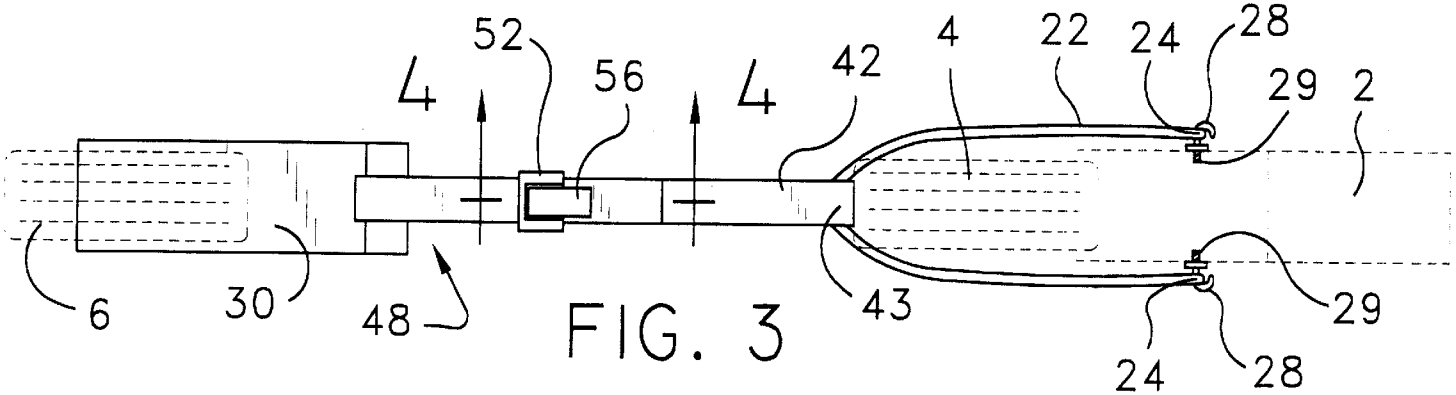
FIG. 3 is a top view of the present invention in use.
Figure 4:
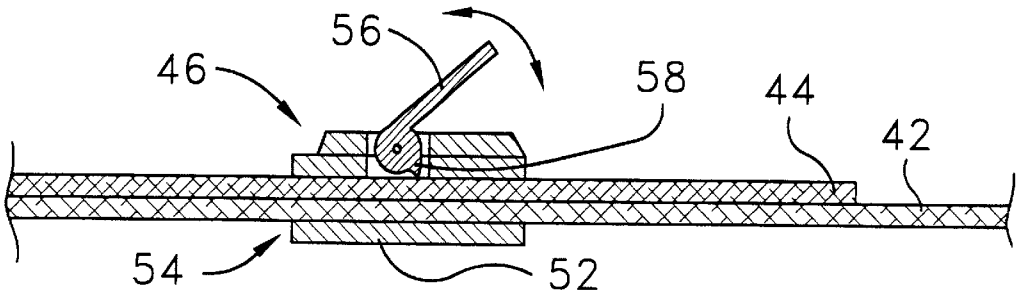
FIG. 4 is a cross-sectional view of the present invention taken along line 4—4 of FIG. 3.
Figure 5:
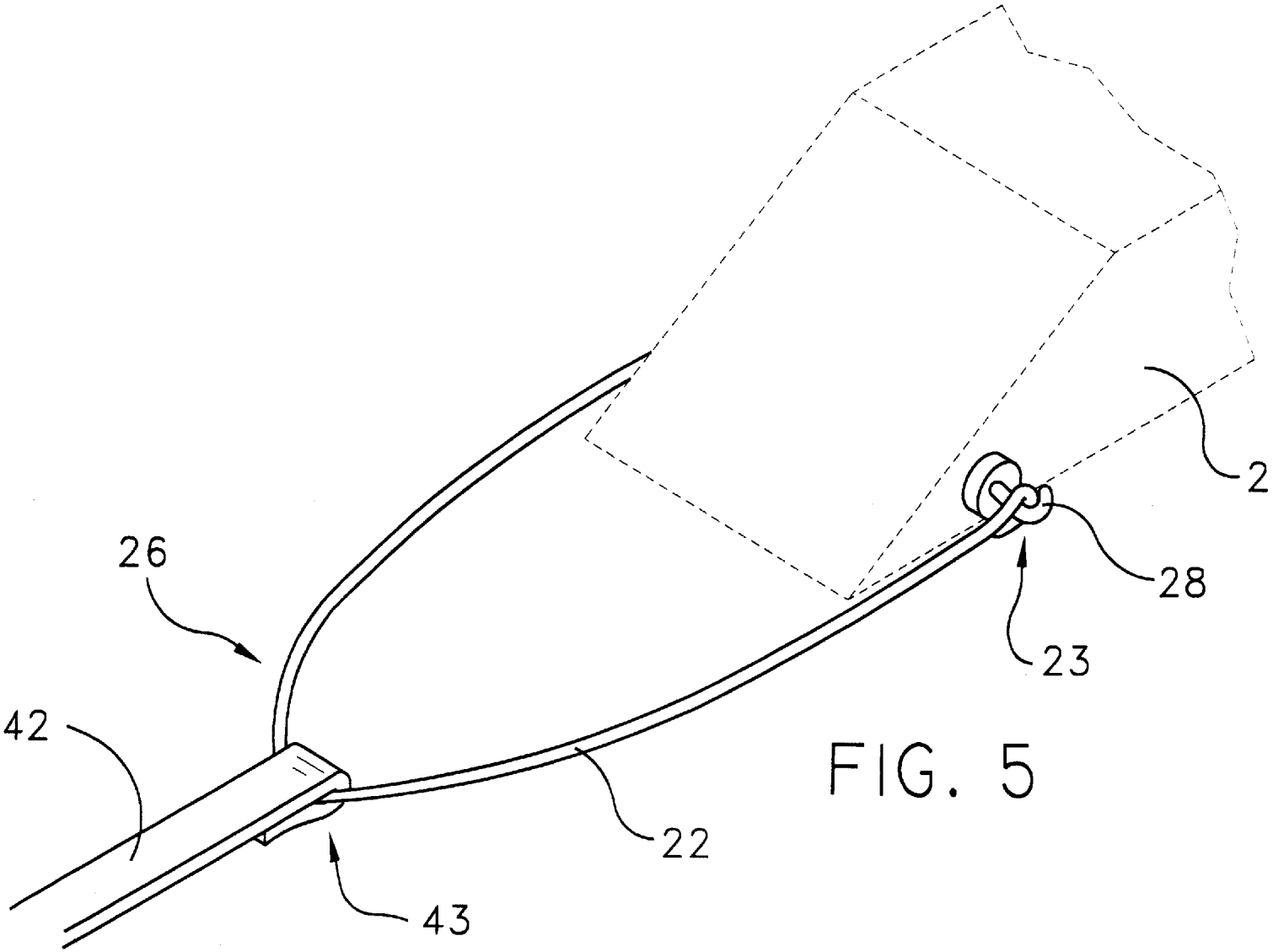
FIG. 5 is a perspective view of the attachment assembly of the present invention.

With reference now to the drawings, and in particular to FIGS. 1 through 5 thereof, a new vehicle ramp stabilizing assembly embodying the principles and concepts of the present invention and generally designated by the reference numeral 10 will be described.

As best illustrated in FIGS. 1 through 5, the vehicle ramp stabilizing assembly 10 generally comprises an attachment assembly 20 designed for coupling to a ramp 2, a belt portion 30, and a length adjustment portion 40 coupling the attachment assembly 20 to the belt portion 30 such that the ramp 2 is positionable in front of a front wheel 4 of a vehicle when the belt portion 30 is positioned beneath a rear wheel 6 of the vehicle. Thus, the weight of the vehicle on the belt portion 30 prevents the ramp 2 from moving away from the front wheel 4 to facilitate driving the vehicle onto the ramp 2.

The attachment assembly 20 includes a line member 22 having opposite ends 24. Each of the ends 24 is designed for coupling to an associated side of the ramp 2. A medial portion 26 of the line member 22 is coupled to the length adjustment assembly 40. The line member 22 has a length such that the line member 22 is designed for extending around the front wheel 4 of the vehicle when the opposite ends 24 are coupled to the ramp 2 and the ramp 2 is positioned in front of the front wheel 4.

The medial portion 26 of the line member is slidable through the length adjustment assembly 40 to facilitate attachment of the opposite ends 24 to the ramp 2.

A pair of hook members 28 are provided. Each of the hook members 28 is designed for coupling to the ramp 2. As shown, the hook members include threaded attachment portions 29 for screwing into the ramp 2. The opposite ends 24 of the line member 22 are formed into line loops 23 for engaging the hook members 28 to couple the line member 22 to the ramp 2.

The length adjustment assembly 40 includes a strap member 42 having a first end 43 and a second end 44. The first end 43 is coupled to the attachment assembly 20. A clasp 46 is operationally coupled to a medial portion 45 of the strap member 42 to form a strap loop 48. The strap loop 48 is coupled to the belt portion 30.

The clasp 46 includes a base portion 52 having a conduit 54 for slidably receiving the strap member 42 therethrough when the strap member 42 is folded over to form the strap loop 48. A locking arm 56 is pivotally coupled to the base portion 52 such that the locking arm 56 is pivotable between a locking position and an adjustment position. The locking arm 56 includes a protrusion 58 extending into the conduit 54 to engage the strap member 42 when the locking arm 56 is in the locking position. Thus, the strap member 42 is prevented from moving relative to the clasp 46. The protrusion 58 is removed from the conduit 54 when the locking arm 56 is in the adjustment position to permit sliding of the strap member 42 in the conduit 54.

In use, duplicate structures of the invention are used on each side of a vehicle. It is possible to make adjustments for desired length and lay the present invention out along a pathway to the ramp. It is further possible as an alternative to drive the vehicle to position the rear wheels on the respective belt portions. The ramps may then be positioned adjacent to the front wheels. The locking arm may be positioned in the adjustment position to permit adjustment of the length of the respective straps to permit attachment of the line member to the respective ramp. Each strap may then be adjusted to hold the respective ramp in proper position against the respective front wheel. The locking arm is positioned in the locking position to prevent further adjustment of the strap length and the vehicle may be driven safely onto the ramps.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A vehicle ramp stabilizing assembly for stabilizing a ramp as a vehicle is driven onto the ramp, said vehicle ramp stabilizing assembly comprising:

an attachment assembly adapted for coupling to the ramp;

a belt portion;

a length adjustment portion coupling said attachment assembly to said belt portion such that the ramp is positionable in front of a front wheel of the vehicle when said belt portion is positioned beneath a rear wheel of the vehicle whereby a weight of the vehicle on the belt portion prevents the ramp from moving away from the front wheel to facilitate driving the vehicle onto the ramp; and wherein said attachment assembly further includes a line member having opposite ends, each of said ends being adapted for coupling to an associated side of the ramp, a medial portion of said line member being coupled to said length adjustment assembly, and said line member having a length such that said line member is adapted for extending around the front wheel of the vehicle when said opposite ends are coupled to the ramp and the ramp is positioned in front of the front wheel.

2. The vehicle ramp stabilizing assembly of claim 1 wherein said medial portion of said line member is slidable through said length adjustment assembly to facilitate attachment of said opposite ends to the ramp.

3. The vehicle ramp stabilizing assembly of claim 1 further comprising:

a pair of hook members, each of said hook members being adapted for coupling to the ramp; and wherein said opposite ends of said line member are formed into line loops for engaging said hook members to couple said line member to the ramp.

4. The vehicle ramp stabilizing assembly of claim 1 wherein said length adjustment assembly further comprises:

a strap member having a first end and a second end, said first end being coupled to said attachment assembly;

a clasp operationally coupled to a medial portion of said strap member to form a strap loop, said strap loop being coupled to said belt portion.

5. The vehicle ramp stabilizing assembly of claim 4 wherein said clasp further comprises:

a base portion having a conduit for slidably receiving said strap member therethrough when said strap member is folded over to form said strap loop;

a locking arm pivotally coupled to said base portion such that said locking arm is pivotable between a locking position and an adjustment position; and said locking arm including a protrusion extending into said conduit to engage said strap member when said locking arm is in said locking position whereby said strap member is prevented from moving relative to said clasp, said protrusion being removed from said conduit when said locking arm is in said adjustment position to permit sliding of said strap member in said conduit.

6. A vehicle ramp stabilizing assembly for stabilizing a ramp as a vehicle is driven onto the ramp, said vehicle ramp stabilizing assembly comprising:

an attachment assembly adapted for coupling to the ramp;

a belt portion;

a length adjustment portion coupling said attachment assembly to said belt portion such that the ramp is positionable in front of a front wheel of the vehicle when said belt portion is positioned beneath a rear wheel of the vehicle whereby a weight of the vehicle on the belt portion prevents the ramp from moving away from the front wheel to facilitate driving the vehicle onto the ramp;

wherein said attachment assembly further includes a line member having opposite ends, each of said ends being adapted for coupling to an associated side of the ramp, a medial portion of said line member being coupled to said length adjustment assembly, and said line member having a length such that said line member is adapted for extending around the front wheel of the vehicle when said opposite ends are coupled to the ramp and the ramp is positioned in front of the front wheel;

wherein said medial portion of said line member is slidable through said length adjustment assembly to facilitate attachment of said opposite ends to the ramp;

a pair of hook members, each of said hook members being adapted for coupling to the ramp;

wherein said opposite ends of said line member are formed into line loops for engaging said hook members to couple said line member to the ramp;

wherein said length adjustment assembly further includes a strap member having a first end and a second end, said first end being coupled to said attachment assembly, and a clasp operationally coupled to a medial portion of said strap member to form a strap loop, said strap loop being coupled to said belt portion; and wherein said clasp further includes a base portion having a conduit for slidably receiving said strap member therethrough when said strap member is folded over to form said strap loop, a locking arm pivotally coupled to said base portion such that said locking arm is pivotable between a locking position and an adjustment position, and said locking arm including a protrusion extending into said conduit to engage said strap member when said locking arm is in said locking position whereby said strap member is prevented from moving relative to said clasp, said protrusion being removed from said conduit when said locking arm is in said adjustment position to permit sliding of said strap member in said conduit.

* * * * *